United States Patent [19]

Nakamura

[11] 4,069,666

[45] Jan. 24, 1978

[54] INTERNAL COMBUSTION GASOLINE ENGINE

[75] Inventor: Hiroyuki Nakamura, Higashiyamato, Japan

[73] Assignee: Fuji Jukogyo Kabushiki Kaisha, Tokyo, Japan

[21] Appl. No.: 596,522

[22] Filed: July 16, 1975

[30] Foreign Application Priority Data

Nov. 26, 1974 Japan ..... 49-136488

[51] Int. Cl.[2] ..... F02M 25/06; F01N 3/10

[52] U.S. Cl. ..... 60/278; 60/293; 60/305

[58] Field of Search ..... 60/293, 305, 307, 298, 60/278

[56] References Cited

U.S. PATENT DOCUMENTS

| | | | |
|---|---|---|---|
| 3,054,390 | 9/1962 | Maurer | 123/188 M |
| 3,468,124 | 9/1969 | Hraboweckyi | 60/305 |
| 3,477,227 | 11/1969 | Bettega | 60/298 |
| 3,653,212 | 4/1972 | Gast | 60/293 |
| 3,662,541 | 5/1972 | Sawada | 60/293 |
| 3,797,241 | 3/1974 | Kern | 60/305 |
| 3,864,909 | 2/1975 | Kern | 60/282 |
| 3,906,722 | 9/1975 | Garcea | 60/293 |
| 3,946,558 | 3/1976 | Beckhuis | 60/282 |

*Primary Examiner*—Douglas Hart
*Attorney, Agent, or Firm*—Martin A. Farber

[57] ABSTRACT

An internal combustion gasoline engine for reducing undesirable exhaust emissions, hydrocarbons, carbon monoxide and nitrogen oxides mainly by means of the design techniques for exhaust passages. The present engine comprises two determined regions extending from an exhaust valve downwards in the exhaust passage so as to pass exhaust gases therethrough in their discharging order, one region having a volume permitting self-reaction of unburned constituents of exhaust gases therein at a temperature of the exhaust gases and another having so much volume and sectional area as capable of aspirating air by itself (automatically) through a check valve into the exhaust passage.

4 Claims, 12 Drawing Figures

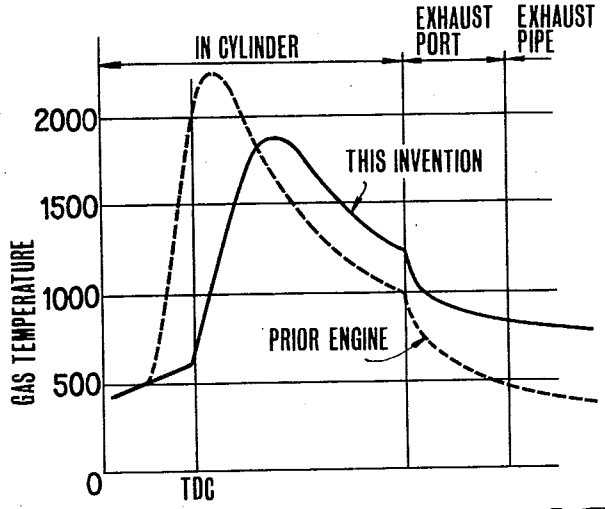
FIG.10.
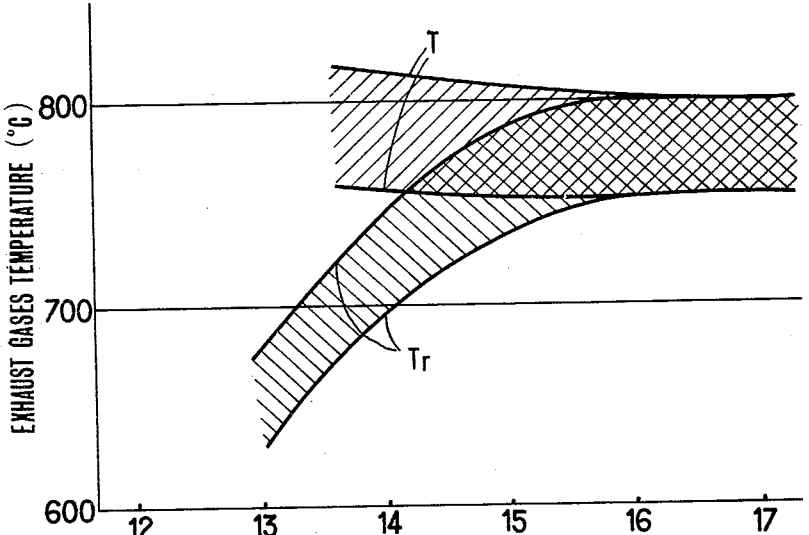
FIG. 4.
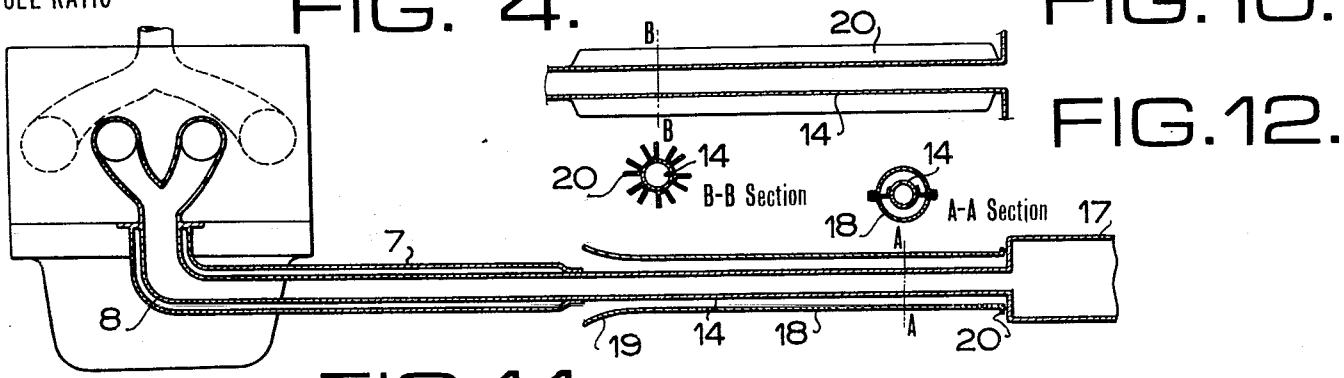
FIG.12.
FIG.11.

INTERNAL COMBUSTION GASOLINE ENGINE

DETAILED DESCRIPTION OF THE INVENTION

The present invention relates to an internal combustion gasoline engine improved for exhaust gas clarification.

The prior art gasoline engine generally has an air-fuel mixture set near the stoichiometric air-fuel ratio, commonly 13.5 to 16 in view of the power performance, fuel consumption and driveability of the engine. Also generally in prior techniques, in order to reduce nitrogen oxides (thereinafter referred to as NOx) in exhaust gases by use of exhaust gas recirculation and especially to reduce NOx to the highly lower level, such as 20 to 10 per cent of that of the prior art engine, the carburetor of that engine is required to be set slightly richer than the stoichiometric air-fuel ratio for securing driveability and performance of after-treatment devices.

In case of reducing hydrocarbons and carbon monoxides (thereinafter referred to as HC and CO, respectively) by means of after-treatment devices, secondary air should be supplied due to the lack of oxygen remaining in exhaust gases.

Of two well-known types of after-treatment devices, one is a system using oxidation catalyst to oxidize HC and CO under a relatively lower temperature (350° to 500° C) with secondary air supplied to the exhaust system and another furnishing the exhaust system with an enlarged chamber or thermal reactor to reach HC and CO continuously therein by the aid of secondary air supplied, holding the inner temperature of the thermal reactor over its reaction temperature.

The former method employing catalyst, however, has some undesirable problems, such as high cost, its unsatisfactory market supply, nonavailability of leaded gasoline and its possible adverse effect on human health.

As for the latter system, it is desirable to position a thermal reactor near the engine as much as possible to utilize the heat of exhaust gases before this heat gets out, and so usually it is directly connected to the exhaust port. However this brings two disappointments; first, the loss of so-called "inertia effect" of the exhaust gas stream and second, the loss of so-called "pulsation effect" in the exhaust passage. The former loss implies that power-up means by said inertia effect cannot be expected and the latter that such an air supply means utilizing said pulsation effect as in the present invention cannot be employed other than compulsory air induction means, such as air pumps, when secondary air is needed.

The present invention provides an internal combustion gasoline engine having a very simple construction which includes an exhaust passage with a special configuration and a determined volume defined hereafter. Said exhaust passage maintains exhaust gases together with secondary air therein at a high temperature for some periods, thus improving the reduction of HC and CO in exhaust gases remarkably, even in the state of the shortage of oxygen remaining in the discharged exhaust gases.

In the drawings:

FIG. 4 is a graph showing a relationship between the air fuel ratio and the exhaust gas temperature;

FIG. 10 is a graph showing an exhaust gas temperature of the invention compared with a prior engine;

FIG. 11 is a side view of a cooling device for the exhaust passage; and

FIG. 12 is a broken away side view showing another cooling device.

Figure 2:
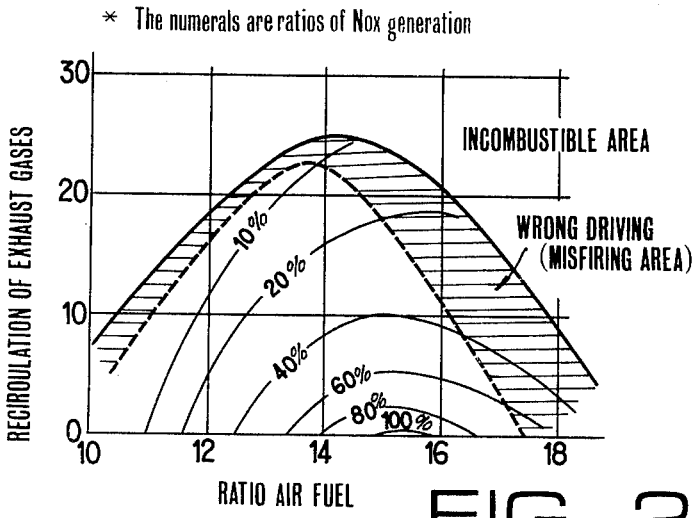
FIG. 2 is a graph showing a relationship between the air fuel ratio, amount of nitrogen oxides and the recirculation ratio of the exhaust gases.
Figure 3:
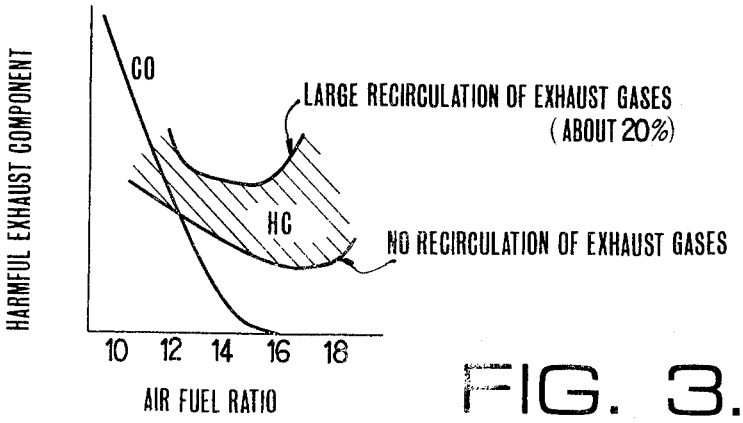
FIG. 3 is a graph showing a relationship between the air fuel ratio and the harmful exhaust components.

This inventor obtained experimentally NOx generation ratios in the relation between the air-fuel ratio and that of the exhaust gas recirculation. This is indicated in FIG. 2 wherein the generation ratio is measured on a base-line (100% generation) when an air-fuel ratio is within a region of 15 to 16 without the exhaust gas recirculation. This drawing tells us that the engine should be operated at the region above the 10 or 20 percent line of NOx generation ratio and the air fuel ratio should be set at 11 through 16 in order to obtain less than 10 or 20 percent level of NOx as compared with that of the prior art engine. However, it is unprofitable to use the lower air fuel ratio (11) because of high HC and CO formation as shown in FIG. 3, and to utilize the upper ratio causes poor driveability due to the rough combustion of the engine. In practice, therefore, it is preferable to use a slightly richer air fuel ratio than the stoichiometric.

In these circumstances, an idea that even in the conventional type of exhaust manifolds and exhaust pipes, if a certain temperature condition was given to the exhaust gases passing therethrough, the continuous self-reaction of HC and CO emissions might be able to be caused in the same manner as in an enlarged chamber like a thermal reactor, had struck the inventor.

He tried experiments to achieve a temperature at which the self-reaction could be caused and a period during which that temperature should be maintained. The engine employed for these experiments was equipped with heat-insulated exhaust pipes for maintaining a high temperature with such configuration as to pass the exhaust gases continuously and smoothly therethrough in their discharging order, i.e., with a simple construction having no enlarged volume along the way. Its air-fuel ratio was set ranging from 13.5 to 16.

Figure 1:
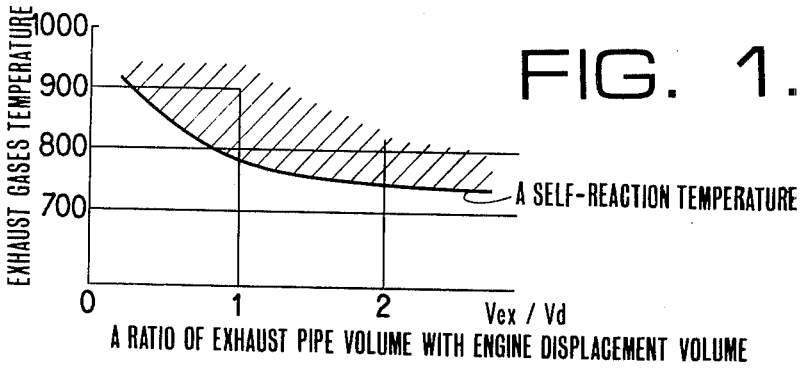
FIG. 1 is a graph showing a relationship between the self-reaction temperature in an exhaust passage without stagnating portion of the gas and the volume of the exhaust passage.

FIG. 1 is an illustration obtained from the above experimental results to show a relationship between the volume of the heat-insulated exhaust passage and the exhaust gas temperature therein at which the self-reaction could be produced. The vertical axis is temperature of exhaust gas and the horizontal axis is a ratio of $Vex$ to $Vd$. Here $Vex$ is a volume of said exhaust passage and $Vd$ is an engine displacement volume. A curve illustrated in FIG. 1 indicates a minimum temperature at which the exhaust gases are capable of being self-reacted and the hatching zone shows an area available for HC reduction below 10 ppm and CO below 0.05 or 0.1 percent.

It should be noted that said line and zone showing a necessary relationship between the exhaust gas temperature and the volume of the exhaust passage to obtain the above figures of reduction, are one of the important conditions which I claim in the present invention. Herein I define the exhaust gas temperature along the line mentioned above as a "a self-reaction temperature".

A self-reaction temperature (T) in this invented system is shown in FIG. 4 as distinguished from a trigger temperature (T*r*) which is a lower limit of the inlet temperature starting the reaction in an enlarged chamber of the prior art system. The self-reaction temperature (T) and the trigger temperature (T*r*) are indicated as a hatching zone respectively, bordered by two curved lines, the upper one measured when the volume of the exhaust passage is the same as the displacement volume and the lower one measured when the volume of the exhaust passage is four times of the displacement volume.

In the prior thermal reactor system the exhaust gases can proceed the self-reaction, provided the exhaust gas temperature at the inlet be maintained over the trigger temperature, because there occurs a mixing of exhaust gases in the thermal reactor. Hereinafter a "mixing" is defined as a phenomenon of gases mixing with themselves in a chamber. When it occurs chemical reaction generally advances substantially.

In the present invention, however, it is absolutely necessary to keep the exhaust gas temperature above a self-reaction temperature higher than the trigger one in order to react the exhaust gases in the exhaust passage, because the exhaust passage is so shaped as to pass exhaust gases continuously and smoothly according to their discharging order without mixing of exhaust gases.

Let us discuss an approach how to obtain the self-reaction temperature higher than the trigger temperature.

The exhaust gas temperature of the prior art engine as shown in FIG. 10 is about 1,000° C before the exhaust valve opens and is lowered to about 800° C when exhaust gases are discharged through the exhaust valve to the exhaust passage. After that, the gas temperature is rapidly cooled by the wall of the exhaust passage, thus in the exhaust manifold and/or exhaust pipes it is decreased to a low temperature (generally, 350° to 500° C) which is not appropriate for clarification of HC and/or CO.

In contradistinction to the prior art, the present engine takes a means for reducing the combustion velocity in cylinders with an ignition retard, for example, 10° to 20° retarded relative to MBT (minimum advance for best torque) or with exhaust gas recirculation (EGR) so as to raise the gas temperature the before exhaust valve opens to a high one, for example, 1200° C which enables the exhaust gas temperature at discharging to be held at around 100° C.

Another means, in addition to this, is taken for keeping these high temperature exhaust gases after discharging as high as possible with heat insulators installed in the exhaust passage and hereby combustible contaminants therein are oxidized without entailing any power loss due to defective inertia effect as in the case of using thermal reactors. In this case, if oxygen is needed for that oxidation, secondary air may be provided into the exhaust passage.

The engine according to the present invention, in its practical usage, requires a means for supplying secondary air to the exhaust passage because the carburetor of the engine should be set slightly richer than the stoichiometric, inasmuch as oxygen remaining in the exhaust gases is insufficient to oxidize combustibles, such as HC and CO. Generally in the prior art engine a compulsory air supply system like an air injection pump is employed for this purpose.

The present engine, however, adopts a means for aspirating secondary air into the exhaust system by operation of an exhaust "pulsation effect" mentioned before only with a check valve, instead of using such power consuming hardware as air pumps.

Said check valve serves the following function. When the pressure of the exhaust gas stream is lower than the atmospheric pressure, it intakes air from the outside and when higher it closes to prevent exhaust gases from flowing back outwards. Accordingly, an amount of secondary air is dependent upon the extent of the vacuum pressure based on pulsation and the period thereof.

Figure 5:
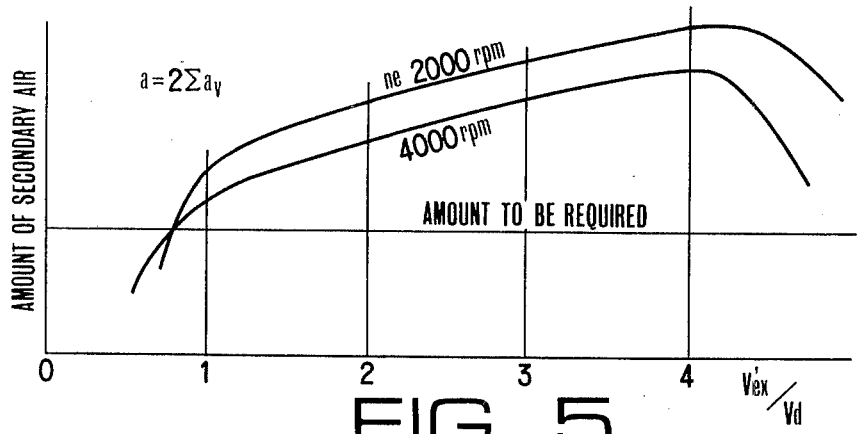
FIG. 5 is a graph showing a relationship between the volume of the exhaust passage and the amount of secondary air.
Figure 6:
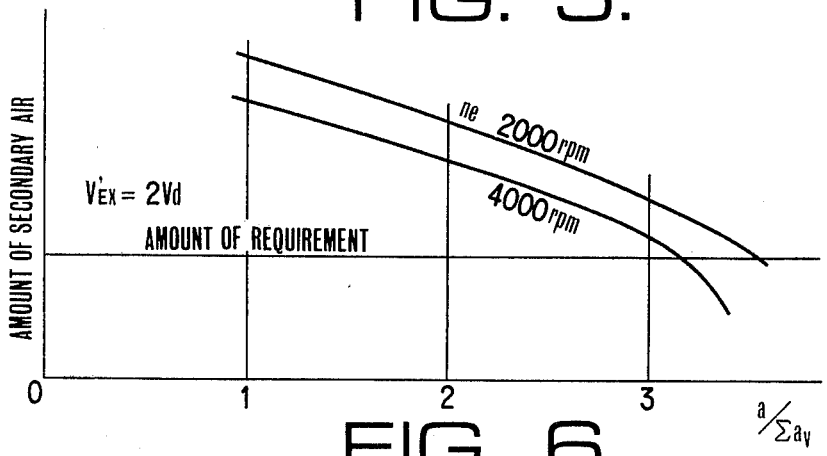
FIG. 6 is a graph showing a relationship between the sectional area of the exhaust passage and the amount of the secondary air.
Figure 7:
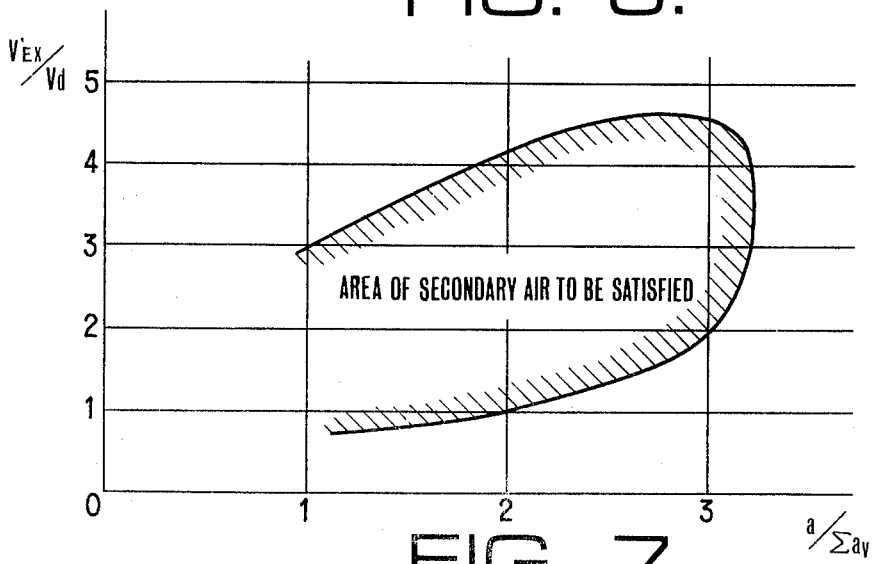
FIG. 7 is a graph showing a zone to obtain a sufficient amount of secondary air.

The inventor examined experimentally how the amount of secondary air varies according to the volume and the cross-sectional area of the exhaust passage extending from the exhaust valve to the inlet of the enlarged chamber (in this case, a muffler), thereby obtaining the resultant data as shown in FIG. 5 through FIG. 7.

FIG. 5 includes a vertical axis for intake amounts of secondary air and a horizontal axis for the ratio of the volume (hereinafter referred to as $V'ex$) of the exhaust passage which extends from the exhaust valve to the inlet of an enlarged chamber or the open vent to atmosphere to the displacement volume (hereinafter referred to as $V_d$). Here, said exhaust passage ($V'_{ex}$) should be formed as to pass exhaust gases therethrough continuously and smoothly in their discharging order. Curves of FIG. 5 are representative results of experiments at 2,000 and 4,000 rpm of the engine revolution, respectively, in that case where the cross-sectional area of the exhaust passage (hereinafter referred to as a) is twice as large as the totaled area (hereinafter referred to as $\Sigma a_v$) of the maximum opening area (hereinafter referred to as $a_v$) of the exhaust valve corresponding to said exhaust passage.

FIG. 6 includes a vertical axis for intake amounts of secondary air and a horizontal axis for the ratio of the cross-sectional area ($a$) of the exhaust passage to the totaled areas ($\Sigma a_v$) as above defined. Curves in FIG. 6 are representative results of experiments given in accordance with the engine revolution of 2,000 and 4,000 rpm in that case where the volume ($V'_{ex}$) is twice as large as the displacement volume ($V_d$).

Referring to FIG. 5 and FIG. 6 it is understood that in order to get the desired amounts of air the ratio of $V'_{ex}$ to $V_d$ should be chosen within a range between 1 and 4 and the ratio of $a$ to $\Sigma a_v$ should be below 3. In reference to FIG. 7 which shows overall test results when $a/\Sigma a_v$ and $V'_{ex}/V_d$ are changed below 4,000 rpm, we can understand that the volume and the cross-sectional area of the exhaust passage should be chosen within a hatching zone to maintain the sufficient amount of secondary air. The exhaust passage, if determined as above, provides a sufficient inertia effect, thus frees the engine from power loss, differently from the prior thermal reactor system.

Furthermore the present invention provides an internal combustion gasoline engine having means for preventing "overheating" of the exhaust system. "Overheating" is defined here as a phenomenon; when persistent misfire happens in more than one cylinder, unburned mixture gas comes into an after-treatment device, such as a thermal reactor, a catalyst converter, and immediately burns quickly therein, causing damage to itself or other surrounding materials in some cases.

Said overheating is generally boosted by a "mixing" effect mentioned previously and high temperature. First, the present engine never causes overheating at least in the determined exhaust passage because exhaust gases stream therein continuously and smoothly without a mixing, therefore rapid combustion does not occur in the passage. Second, in an enlarged chamber after the determined exhaust passage it provides means for keeping off overheating thereof by determining the volume (referred to as $V''_{ex}$ hereinafter) of the exhaust passage from the exhaust valve to the inlet of the enlarged chamber so as to lower the exhaust gas temperature in the enlarged chamber to such an extent that unburned mixture gas therein due to misfire does not ignite in a mixing condition. Said means may involve a method of cooling a portion of the exhaust passage and/or the enlarged chamber itself compulsory or spontaneously.

Figure 8:
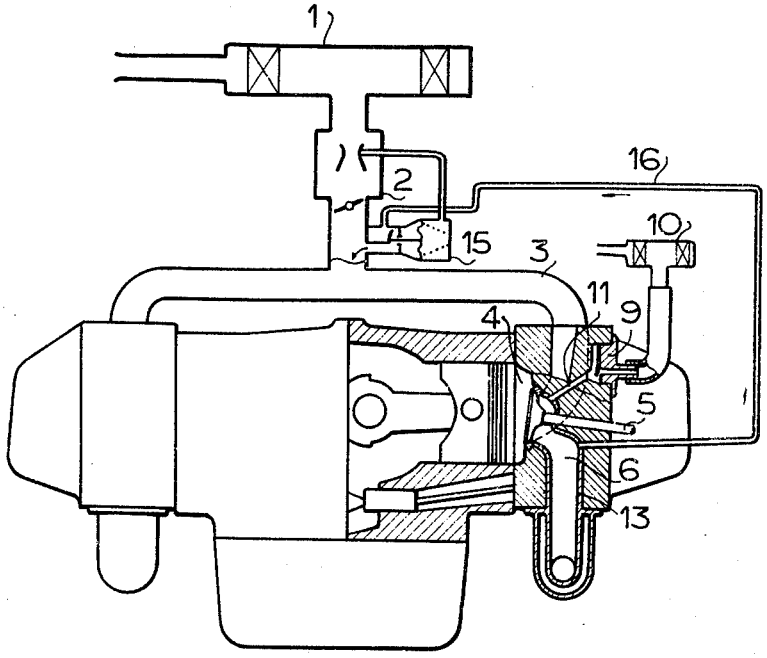
FIG. 8 is a front elevation of an embodiment of an exhaust gas purification system of the present invention.
Figure 9:
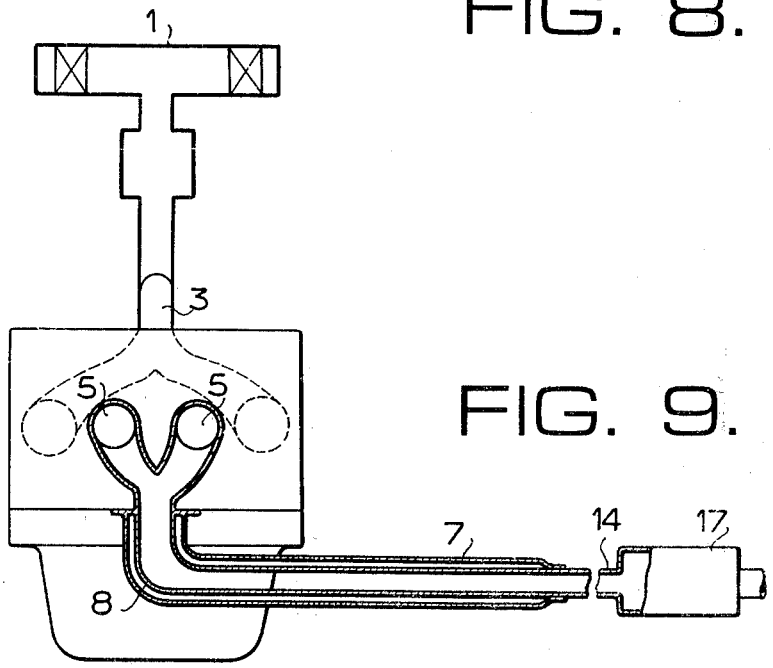
FIG. 9 is a side view of the engine of FIG. 8.

An embodiment of this invention will be explained by the accompanying drawings. FIG. 8 and FIG. 9 illustrate an engine according to the present invention, including an air cleaner 1 and a carburetor 2, which is improved on the prior carburetor and set at the air-fuel ratio near the stoichiometric or approximately 13.5 to 16. The engine further includes an intake manifold 3, a combustion chamber 4, an exhaust valve 5 disposed in an exhaust port 6 which is covered all-over by a port liner 13 (hereafter described on its embodiments) including the exhaust valve seat, and an exhaust manifold and/or exhaust pipe 8 communicated with the exhaust port 6. The exhaust manifold and/or exhaust pipe 8 communicates with the exhaust port 6.

The exhaust manifold and/or exhaust pipe 8 which extends from the exhaust valve 5 downstream through the exhaust line is so shaped as to pass exhaust gases continuously and smoothly therethrough in their discharging order and to possess a determined volume. The exhaust manifold and/or the exhaust pipe 8 are heat-insulated by means of duplicated wall or heat-insulation wall 7 so as to maintain exhaust gases therein above a self-reaction temperature as shown in the hatching zone of FIG. 1.

The exhaust manifold and/or the exhaust pipe 8 may include a portion 14 without heat insulation following the heat-insulated portion 8, and possess a determined volume which is chosen between one and four times of the displacement volume and also possess a cross-sectional area chosen below three times of the total of the maximum opening area of the exhaust valve corresponding to the exhaust passage. In this embodiment, the portion 14 may be connected to the inlet of a muffler 17. Between the exhaust port 6 and the intake manifold 3 there communicates a passage 16 for the exhaust gas recirculation with an EGR valve 15 so as to recirculate a part of exhaust gases into the intake manifold 3 for the purpose of reducing the peak combustion temperature in cylinders to surpress the NOx formation.

An intake passage 11 for secondary air communicates with the exhaust port 6 with its opening adjacent to the exhaust valve 5 and also communicates with the air cleaner 10. A check valve 9 is disposed in the intake passage 11 to open when the exhaust gas pressure is lower than atmospheric pressure and to close when the former is higher than the latter, by the operation of exhaust pulsation. The negative pressure caused by the pulsation enables secondary air to be introduced from the air cleaner 10 into the exhaust passage.

In this embodiment, the ignition timing is delayed by about 10° to 20° compared with MBT further to raise the exhaust gas temperature. In those constitutions NOx can be reduced by about 10 or 20 percent compared to the conventional engine by the peak combustion temperature reduction to 2,000° C and below by these means, i.e., the carburetor which is set slightly richer near the stoichiometric, the exhaust gas recirculation with 15 to 20 percent of recirculation ratio and the retarded ignition timing.

The combustion is retained to be slow almost similarly to an isothermal combustion, thereby to increase the exhaust gas temperature, for instance, reaching above, 1,000° C before the exhaust valve 5 opens.

The exhaust gases are maintained at a temperature higher than about 800° C by means of heat-insulations such as 13 and 7 in a suitable period during which the exhaust gases pass through a volume, in the exhaust passage, for example, the same volume as that of the displacement. Thus, the exhaust gas temperature goes up over the self-reaction temperature to enhance the oxidation reaction of combustible pollutants in exhaust gases by the aid of secondary air introduced through the passage 11 into the exhaust passage.

FIG. 11 and FIG. 12 illustrate embodiments of a cooling method applied to the exhaust passage according to the present engine. FIG. 11 shows a method utilizing an outer shell 18 covering an exhaust pipe 14 after heat insulation wall 7. The outer shell has at one end a flare 19 to introduce air easily from the outside and at another end an outlet 20 of air. FIG. 12 explains another cooling method adopted at the same portion as in FIG. 11, utilizing a fin 20 welded to an exhaust pipe in such a way as shown in Section B—B.

What is claimed is:

1. An exhaust gas purification system for an internal combustion engine having at least two cyclinders each having a displacement volume, comprising an exhaust valve for each of said cylinders, an exhaust passage comprising two branch passages each communicating with a corresponding of said exhaust valves, and an exhaust pipe having a substantially constant cross-section communicating with said two branch passages of said at least two cylinders, respectively, said exhaust pipe having an opening end means for providing negative reflected waves, passageway means communicating with said branch passages, respectively, and with a source of secondary air for introducing the secondary air into said exhaust passage, and including a check valve means operatively disposed in said passageway means and responsive to pulsation pressures in said exhaust passage for operatively opening and closing said passageway means.

heat insulation means in a predetermined zone of said exhaust passage extending from said exhaust valves of said at least two cylinders, respectively, for preventing the lowering of exhaust gas temperature in said predetermined zone below a predetermined temperature so as to cause sufficient self-reaction oxidation in said predetermined zone in order to have a HC concentration below 10 ppm and CO concentration below 0.1 percent, the volume of said predetermined zone being at least 2.5 times the displacement volume of said at least two cylinders, respectively, said two branch passages of said at least two cylinders, respectively, plus said exhaust pipe defining a second volume from said exhaust valves to said opening end means being at least equal to 2.5 times the displacement volume of said at least two cylinders, respectively, and less than four times the displacement volume of said at least two cylinders, respectively, and having a cross-sectional area less than three times the total maximum opening area of said exhaust valves corresponding to said exhaust passage, whereby a necessary and sufficient amount of secondary air is substantially uniformly introduced to cause the concentration of HC and CO to be below 10 ppm and 0.1 percent, respectively.

2. An exhaust gas purification system for an internal combustion engine as set forth in claim 1, further comprising an intake manifold, a separate second passageway means communicating with said exhaust passage for recirculating a portion of the exhaust gases to said intake manifold.

3. An exhaust gas purification system for an internal combustion engine as set forth in claim 1, wherein said predetermined temperature constitutes a minimum self reaction temperature for oxidation of CO and HC in said predetermined zone.

4. The system, as set forth in claim 1, further comprising piston means for performing piston strokes in said cylinder, said second volume and said cross-sectional area cause a continuous substantially uniform plurality of pulsation pressure waves in said exhaust passage communicating with said passageway means during all portions of each piston stroke.

* * * * *